US010774562B1

(12) United States Patent
Parker

(10) Patent No.: US 10,774,562 B1
(45) Date of Patent: Sep. 15, 2020

(54) RAILING ANCHOR

(71) Applicant: Alumiworks, Inc., Randleman, NC (US)

(72) Inventor: Wayne Parker, Randleman, NC (US)

(73) Assignee: Alumiworks, Inc., Randleman, NC (US)

( * ) Notice: Subject to any disclaimer, the term of this patent is extended or adjusted under 35 U.S.C. 154(b) by 0 days.

(21) Appl. No.: 16/547,676

(22) Filed: Aug. 22, 2019

Related U.S. Application Data

(60) Provisional application No. 62/882,889, filed on Aug. 5, 2019, provisional application No. 62/879,658, filed on Jul. 29, 2019.

(51) Int. Cl.
*E04H 12/22* (2006.01)
*E04F 11/18* (2006.01)
*E04B 1/00* (2006.01)

(52) U.S. Cl.
CPC ..... *E04H 12/2261* (2013.01); *E04B 1/003* (2013.01); *E04F 11/1812* (2013.01)

(58) Field of Classification Search
CPC .. E04H 12/2261; E04B 1/003; E04F 11/1812; E04F 11/1817
See application file for complete search history.

(56) References Cited

U.S. PATENT DOCUMENTS 3,999,353 A * 12/1976 Dielman ..... E04F 11/1814 52/835
6,141,928 A * 11/2000 Platt ..... E04F 11/1812 52/296
6,718,710 B2 4/2004 Platt ..... 52/296
6,988,700 B2 1/2006 Cote ..... 248/519
9,874,024 B2 1/2018 Green
9,976,298 B2 5/2018 Bergman
10,156,079 B2 * 12/2018 Kennelly ..... E04B 1/185
2006/0022189 A1 * 2/2006 Collins, IV ..... E04H 12/2261 256/65.14
2007/0209316 A1 * 9/2007 Walker ..... E04F 11/1812 52/832
2013/0048825 A1 * 2/2013 Stalemark ..... B23B 47/28 248/534
2014/0008597 A1 * 1/2014 Herman ..... E04F 11/1804 256/64
2016/0047137 A1 * 2/2016 Aagerup ..... E02D 27/12 248/530
2016/0281752 A1 * 9/2016 Koller ..... E04F 11/1814
(Continued)

FOREIGN PATENT DOCUMENTS

EP 1114904 A1 * 7/2001 ..... E04H 12/2261

*Primary Examiner* — Patrick J Maestri
(74) *Attorney, Agent, or Firm* — MacCord Mason PLLC

(57) ABSTRACT

A balcony railing anchor arrangement for a balcony that has a wooden support and a wooden deck on the wooden support. A first metal plate on the wooden deck has threaded holes, and a moisture barrier covers the wooden deck. A lag bolt extends downward from the metal plate through the wooden deck and secured in the wooden support to secure the metal plate onto the wooden deck and the wooden support. Threaded studs extend upward from the holes in the first metal plate. Concrete can be poured on the moisture barrier and the first metal plate and a second metal plate with a post for a railing on the balcony can be mounted atop the concrete by aligning holes in the second metal plate with the studs.

20 Claims, 5 Drawing Sheets

(56) References Cited

U.S. PATENT DOCUMENTS

| | | | | |
|---|---|---|---|---|
| 2017/0247899 | A1* | 8/2017 | Faries | E04H 12/223 |
| 2017/0254107 | A1* | 9/2017 | Vogt | E04H 12/2261 |
| 2018/0251996 | A1* | 9/2018 | Roy | F16M 13/022 |
| 2018/0283011 | A1* | 10/2018 | Pilja | E04H 12/2261 |

* cited by examiner

RAILING ANCHOR

BACKGROUND OF THE INVENTION

The present invention relates to an improvement in mounts for railings, especially on balconies and more especially on balconies made with wood substrates and having lightweight concrete tread surfaces.

Multifamily buildings often have balconies and, where code permits, are often framed with wood. The supports for the balconies extend outward from outer building walls and are often made of wood such as 2×10's. The supports have a wooden deck (particularly plywood or chipboard) topped with a lightweight concrete.

The balconies also need to have railings to protect occupants of the finished dwelling. Aluminum is a preferred railing material for durability and light weight. The railings need to be strong enough to prevent impacts from dislodging the railings from the balcony and, in the balconies discussed above have conventionally been anchored to the wooden support and deck in order to have a strong base.

This form of construction has been found to be cost-effective. An important precaution, though, is that the wooden support and deck must be shielded from water ingress. Penetrating water causes early failure and needs to be avoided.

Usually, a shield to prevent water from getting to the wood is installed, and conventional railing anchors with affixed posts are mounted to the deck so they extend upward as what the trade calls a "missile." Then the concrete is poured. However the missile acts as a large protuberance that can cause its own problems. Workers building the dwelling often use the doorway to the balcony to move construction materials into the building and to remove debris. During those movements, the materials or the worker may collide with the missile, dislodging it and damaging the water-tight seal. Repairing such damage is quite expensive. Thus, there is a need in the art for an improved railing support for a wooden balcony having a lightweight concrete tread surface.

SUMMARY OF THE INVENTION

The present invention fulfills one or more of these needs in the art by providing a railing anchor arrangement that includes a wooden support and a wooden deck on the wooden support. A first metal plate on the wooden deck has threaded holes. A moisture barrier covers the wooden deck and seals to the first metal plate. The moisture barrier can be a waterproof membrane. At least one lag bolt extends downward from the metal plate through the wooden deck and is secured in the wooden support to secure the metal plate onto the wooden deck and the wooden support. Threaded studs extend upward from the holes in the first metal plate. Concrete can be poured on the moisture barrier to make a tread surface and the first metal plate, and a second metal plate with a post for a railing can be mounted atop the concrete by aligning holes in the second metal plate with the studs.

In one embodiment the first metal plate has six holes, with two lag bolts occupying two of the holes and four threaded studs occupying four of the holes. The studs may have nuts above and below the second metal plate to hold the second metal plate spaced above the first metal plate. A shield preferably surrounds each stud between the metal plates to prevent contact of the concrete with the threads of the studs. The shield may be a polyvinyl chloride sleeve.

Preferably, the first metal plate and studs are steel and the post for a railing is aluminum. Places where a steel part is adjacent an aluminum part are provided with an isolation barrier, to prevent galvanic action between the different metals.

The threaded studs that extend upward from the holes in the first metal plate are preferably mounted by mating stud threads to threads in the holes of first metal plate with a thread locker adhesive where the studs mate with the first metal plate.

Typically, the concrete is a lightweight concrete. Preferably, the second metal plate is separated from the concrete by an isolation barrier.

The invention can also be considered as a method of installing a railing on a surface having a wooden support and a wooden deck topped with a moisture barrier and a lightweight concrete surface. The method includes mounting a steel plate on the wooden deck by driving lag bolts downward through holes in the steel plate, through the wooden deck and into the wooden support, the steel plate having threaded studs standing upright from the steel plate. The method also includes applying a moisture barrier to the wooden deck and sealing the moisture barrier against at least edges of the steel plate. Then a lightweight concrete is poured on the moisture barrier and the steel plate to a desired depth, leaving tops of the threaded studs exposed above a top surface of the lightweight concrete. The lightweight concrete is allowed to cure. The method includes subsequently mounting an aluminum railing post on the concrete by fitting an aluminum plate having an affixed aluminum railing post over the threaded studs and tightening nuts onto the threaded studs.

Applying a moisture barrier may be accomplished by adhering a waterproof membrane onto the wooden deck. The steel plate is mounted on a part of the waterproof membrane and then covered with a mastic sealant to prevent water ingress through openings caused by the mounting of the steel plate. The method may include moving materials across the concrete into an adjacent building once the lightweight concrete has cured and before mounting the aluminum railing post The method may include installing a temporary railing post over the studs once the lightweight concrete has cured and before mounting the aluminum railing post The invention can also be considered as a railing anchor for a balcony that has a wooden support, a plywood deck on the wooden support and a moisture barrier covering the plywood deck. The railing anchor includes a steel plate adapted to be mounted on the plywood deck and having four threaded holes and suitable to be mounted on a moisture barrier. Four steel threaded studs extend upward from four of the holes in the steel plate and are mounted to the steel plate by mating stud threads to threads in the holes of steel plate with a thread locker adhesive where the studs mate with the steel plate. Two other holes in the steel plate are configured to receive lag bolts that can extend downward from the steel plate through the plywood deck and be secured in the wooden support to secure the steel plate onto the plywood deck and the wooden support. The holes of the steel plate are preferably arranged in two lines of three holes each. The steel plate may have a centerline marked between the two lines of three holes.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
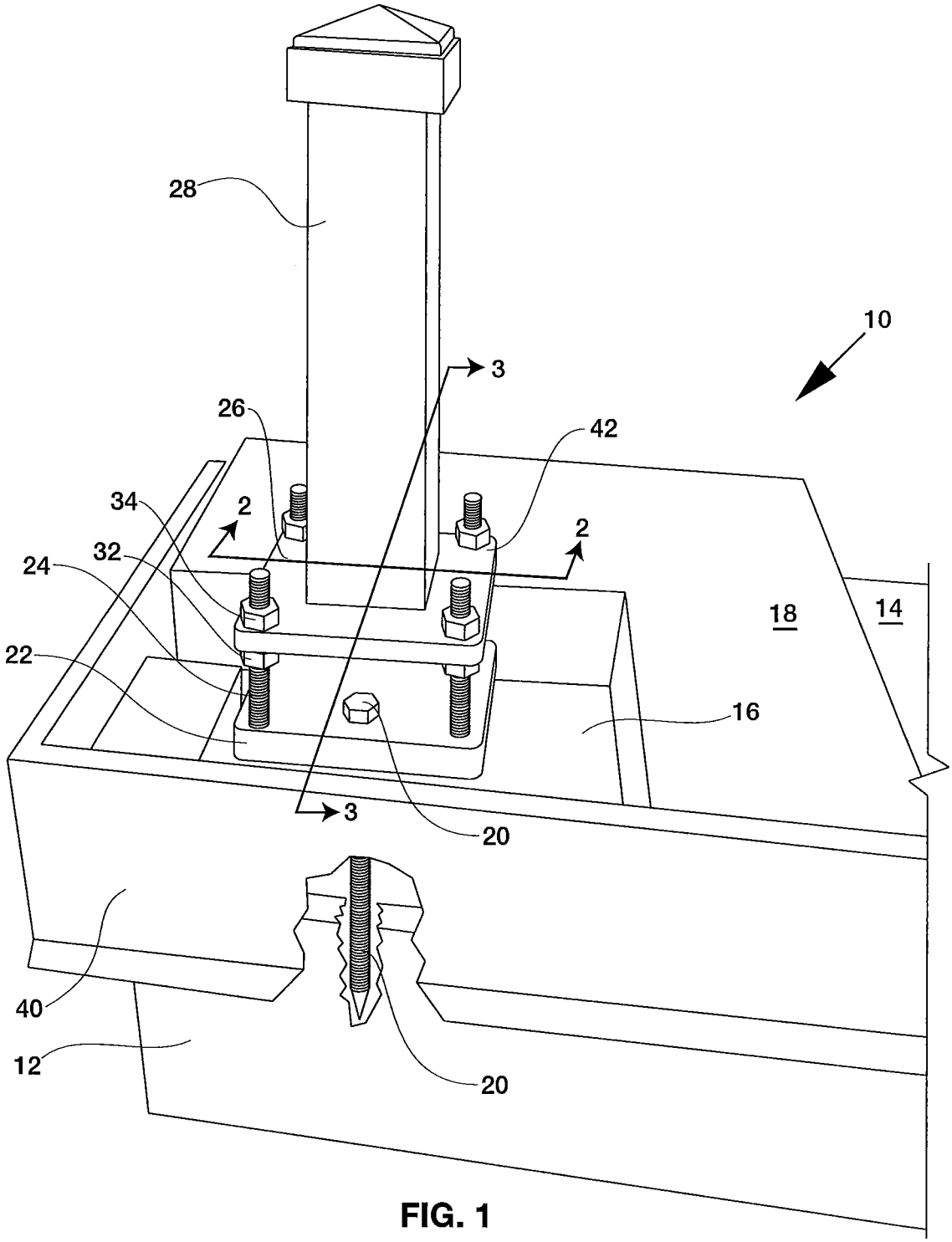
FIG. 1 is a cutaway perspective view of a balcony having an anchor in accordance with an embodiment of the invention.
Figure 2:
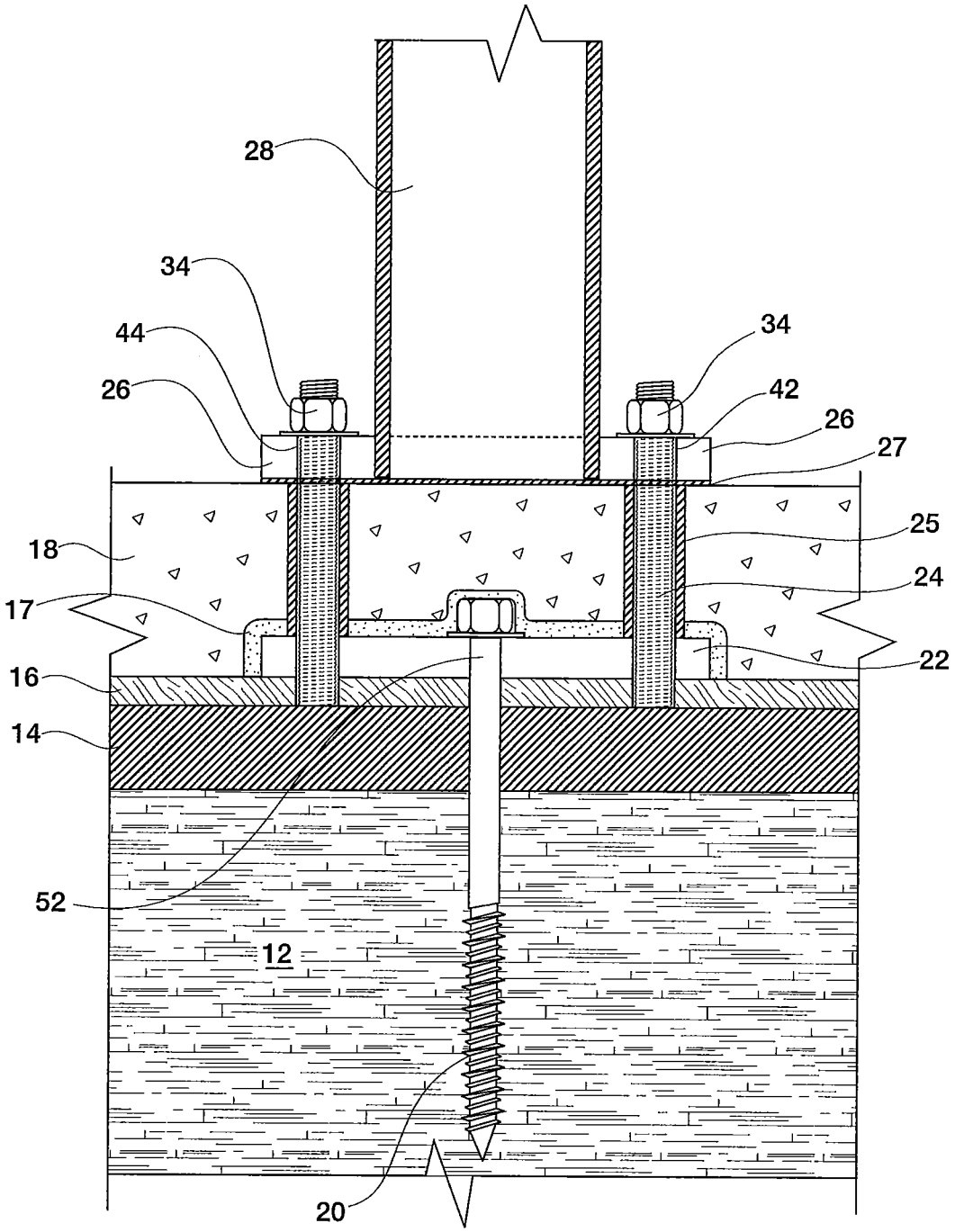
FIG. 2 is a sectional view of the embodiment of FIG. 1 taken along lines 2-2 and looking in the direction of the arrows.
Figure 3:
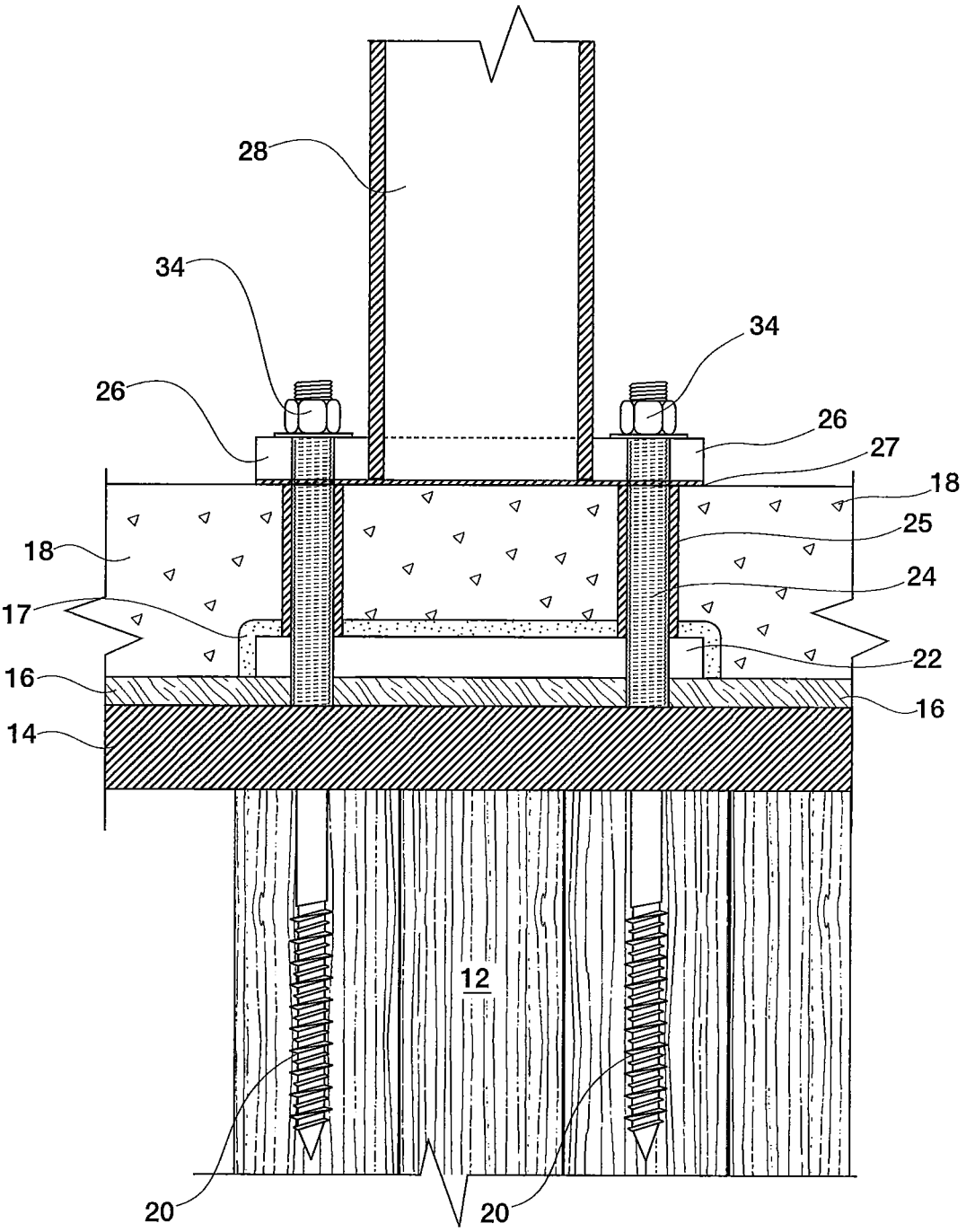
FIG. 3 is a sectional view of the embodiment of FIG. 1 taken along lines 3-3 and looking in the direction of the arrows.

As seen in FIGS. 1-3, a railing anchor arrangement and has a wooden support 12 and a plywood deck 14 on the wooden support. The wooden support or wooden blocking is quite substantial, typically several 2×10's arranged to form a cantilever support from the main building wall (not shown). A moisture barrier 16 (such as a waterproof membrane) covers the plywood deck. A steel plate 22 is mounted on the membrane on the plywood deck. The steel plate 22 has two unthreaded holes 52 and four threaded holes (see FIG. 5). Two steel lag bolts 20 extend downward from the two unthreaded holes 52 in the steel plate through the plywood deck and into the wooden support 12, for instance protruding into non-threaded clearance holes. Four steel threaded studs 24 extend upward from the four threaded holes in the steel plate. The stud shanks can be ⅜ inch in diameter. The holes 52 could be threaded, but that is not necessary. A mastic sealant 17 is applied to the steel plate 22 to seal paths for moisture that may have been formed to the deck 14 by the installation of the steel plate.

Figure 6:
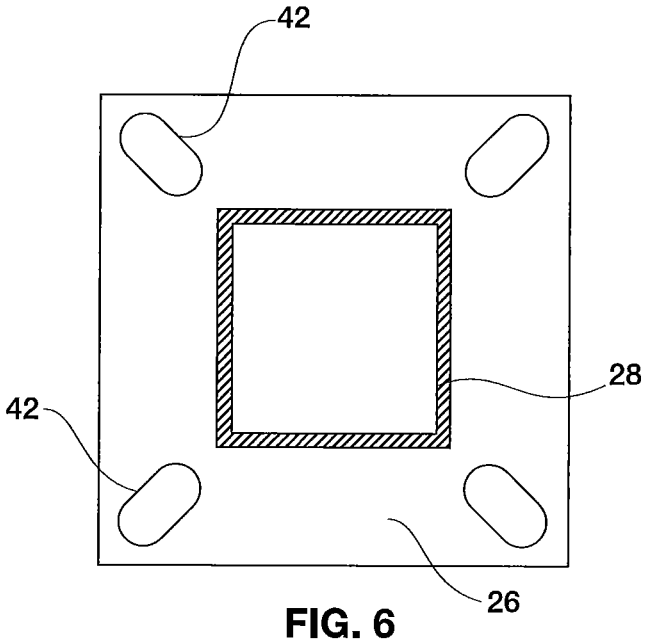
FIG. 6 is a top view of the aluminum plate and post.
Figure 7:
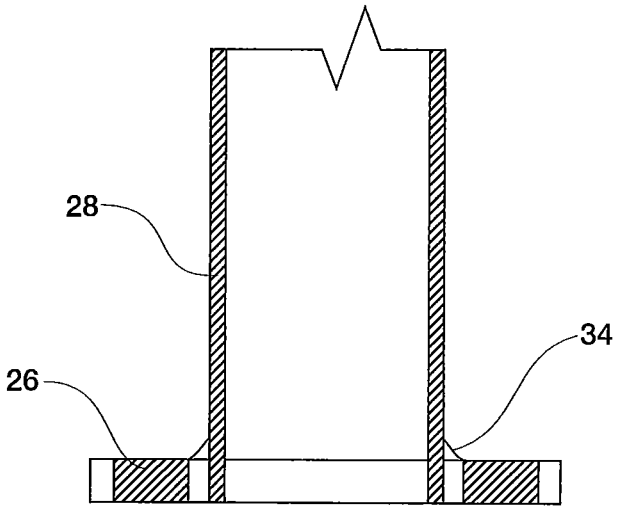
FIG. 7 is sectional view of the aluminum plate and post.

A lightweight concrete 18 can be poured on the moisture barrier 16 and the steel plate 22 to make a tread surface. A form 40 around the perimeter of the deck contains the wet concrete and determines its height. Once the concrete cures, an aluminum plate 26 with a post 28 for a railing can be mounted atop the lightweight concrete by aligning holes 42 (shown in FIGS. 6 and 7) in the aluminum plate with the studs 24.

Figure 4:
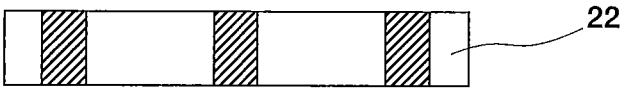
FIG. 4 is a sectional view of the steel plate.
Figure 5:
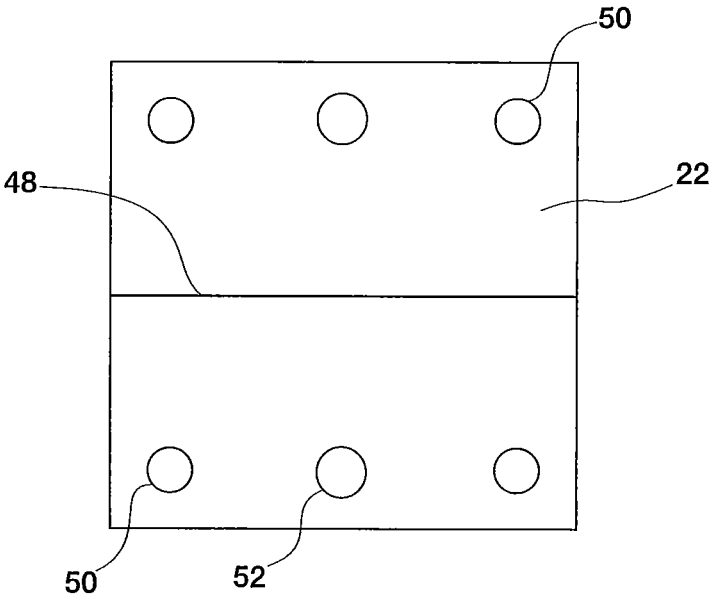
FIG. 5 is a top view of the steel plate.

The steel plate 22 is seen in more detail in FIGS. 4 and 5. A suitable size for the plate is four inches square with a minimum thickness of about ⅝ inch. The holes for the lag bolts and the studs are arranged in two rows of three, but other arrangements may be suitable. The placement of the holes for the studs is such that the studs will align with holes in the aluminum plate 26. The plate 22 may be marked with a centerline between the two rows of holes to aid in placement of the plate on the deck.

The studs 24 may have nuts 34 above and below 32 the aluminum plate to hold the aluminum plate spaced above the steel plate. A shield such as a polyvinyl chloride sleeve or tube 25 preferably surrounds each stud between the steel and aluminum plates. The shield prevents contact of the concrete with the threads of the studs. Places 44 where a steel part is adjacent an aluminum part are provided with an isolation barrier, to prevent galvanic action between the different metals. The aluminum plate 26 is separated from the concrete by an isolation barrier 27.

The railing anchor arrangement can be mounted in a step-wise fashion. Once the wooden support 12 and deck 14 are in place, the waterproof membrane 16 can be installed on the deck 14. The first metal plate 22 can be placed on the membrane 16 on the deck with the centerline parallel with the expected railing direction. The studs 24 are typically already installed on the metal plate 22 with a thread locker adhesive at a factory before the plate is mounted to the deck, but the studs could be installed on the plate on the jobsite.

On the jobsite, the lag bolts are installed to secure the plate 22 to the deck. Then the mastic 17 is applied to the metal plate 22 and a waterproof seal is made between the barrier 16 and the plate 22.

The lightweight concrete can then be poured. The form 40 around the perimeter of the deck contains the wet concrete and determines its height. The only portion of the anchor extending above the top of the concrete is the top portion of the studs 24, since the second plate 26 and its post 28 are added later. In the meantime, workers can access the interior of the building through the door to the balcony to move materials into the building and to remove debris from the building. The small area of the top portion of the studs thus is a small target that is more likely to be avoided by transit of materials in and out of the building than when the posts are missiles. In addition, in the event of a collision with transiting materials or workers, since the studs are smaller than the missiles of the prior art there is a reduced lever arm to dislodge the stud and/or disturb the waterproof barrier. In the event the stud is bent or the barrier is disturbed, the stud can be removed and replaced and the waterproof barrier can be repaired with mastic.

If desired, a temporary railing post can be mounted on the concrete and secured to the studs, such as to comply with worker safety codes that require a temporary guardrail. The railing post can have brackets to removably hold horizontal railings, such as 2×4's. The 2×4's can be moved out of the way when the balcony doorway is being used for transiting materials or workers.

Preferably, the railing that is installed complies with terms on building codes. The railing, post and second plate can be made if various materials, preferably aluminum or steel.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A railing anchor arrangement comprising a wooden support, a wooden deck on the wooden support;

a first metal plate that has holes and that is on the wooden deck;

a moisture barrier covering the wooden deck and sealed to the first metal plate;

at least one lag bolt extending downward through one of the holes in the metal plate, through the wooden deck, and secured in the wooden support to secure the metal plate onto the wooden deck and the wooden support;

threaded studs extending upward from threaded ones of the holes in the first metal plate;

concrete on the moisture barrier and the first metal plate; and a second metal plate with a post for a railing mounted atop the concrete by aligning second holes in the second metal plate with the studs.

2. A railing anchor arrangement as claimed in claim 1 wherein the first metal plate has six holes, with two lag bolts occupying two of the holes and four threaded studs occupying four of the holes.

3. The railing anchor arrangement as claimed in claim 1 wherein the studs have nuts above and below the second metal plate to hold the second metal plate spaced above the first metal plate.

4. The railing anchor arrangement as claimed in claim 1 wherein a shield surrounds each stud between the metal plates to prevent contact of the concrete with the threads of the studs.

5. The railing anchor arrangement as claimed in claim 4 wherein the shield is a polyvinyl chloride sleeve.

6. The railing anchor arrangement as claimed in claim 1 wherein the first metal plate and studs are steel and the second metal plate with the post for a railing are aluminum and places where a steel part is adjacent an aluminum part are provided with an isolation barrier, to prevent galvanic action between the different metals.

7. The railing anchor arrangement as claimed in claim 1 wherein the threaded studs that extend upward from the holes in the first metal plate are mounted by mating the stud threads to the threads in the holes of first metal plate and the threads of the studs have a thread locker adhesive where the studs mate with the threaded holes in the first metal plate.

8. The railing anchor arrangement as claimed in claim 1 wherein the concrete is a lightweight concrete.

9. The railing anchor arrangement as claimed in claim 1 wherein the second metal plate is separated from the concrete by an isolation barrier.

10. The railing anchor arrangement as claimed in claim 1 including a water proofing mastic over the first metal plate.

11. A railing anchor arrangement comprising a wooden support, a plywood deck on the wooden support;

a moisture barrier covering the plywood deck;

a steel plate with six holes on the moisture barrier on the plywood deck;

two steel lag bolts extending downward from two of the holes in the steel plate through the plywood deck and secured in the wooden support to secure the steel plate onto the plywood deck and the wooden support;

mastic sealing on the steel plate; and four steel threaded studs that extend upward from four of the holes in the steel plate and are mounted by mating stud threads to threads in the holes of the steel plate with a thread locker adhesive where the studs mate with the steel plate;

lightweight concrete on the moisture barrier and the steel plate;

an aluminum plate with a post for a railing mounted atop the lightweight concrete by aligning second holes in the aluminum plate with the studs, with the studs having nuts above and below the aluminum plate to hold the aluminum plate spaced above the steel plate;

a polyvinyl chloride sleeve surrounding each stud between the steel and aluminum plates to prevent contact of the concrete with the threads of the studs and places where a steel part is adjacent an aluminum part are provided with an isolation barrier to prevent galvanic action between the different metals; and the aluminum plate is separated from the concrete by an isolation barrier.

12. The railing anchor arrangement as claimed in claim 1 wherein the moisture barrier comprises a waterproofing mastic.

13. A method of installing a railing on a surface having a wooden support and a wooden deck topped with a moisture barrier and a lightweight concrete surface comprising mounting a moisture barrier on the wooden deck;

mounting a steel plate on the moisture barrier on the wooden deck by driving lag bolts downward through holes in the steel plate, through the wooden deck and into the wooden support, the steel plate having threaded studs standing upright from the steel plate, applying a mastic to the steel plate, pouring a lightweight concrete on the moisture barrier and the steel plate to a desired depth, leaving tops of the threaded studs exposed above a top surface of the lightweight concrete and allowing the lightweight concrete to cure, subsequently mounting an aluminum railing post on the concrete by fitting an aluminum plate having an affixed aluminum railing post over the threaded studs and tightening nuts onto the threaded studs.

14. The method as claimed in claim 13 including moving materials across the concrete into an adjacent building once the lightweight concrete has cured and before mounting the aluminum railing post.

15. The method as claimed in claim 13 including installing a temporary railing post over the studs once the lightweight concrete has cured and before mounting the aluminum railing post.

16. A railing anchor assembly to be mounted on a balcony that has a wooden support, a plywood deck on the wooden support and a moisture barrier covering the plywood deck, the assembly comprising:

a steel plate adapted to be mounted on the moisture barrier covering the plywood deck and having six holes, at least four of the holes being threaded holes;

four steel threaded studs that extend upward from the four threaded holes in the steel plate when mounted to the steel plate by mating stud threads to threads in the threaded holes of steel plate;

a thread locker adhesive for application where the studs mate with the steel plate;

the two of the holes in the steel plate configured to receive lag bolts;

two lag bolts that can be extended through the holes in the steel plate that are configured to receive lag bolts through the plywood deck and secured in the wooden support to secure the steel plate onto the plywood deck and the wooden support;

mastic that can be applied to the steel plate to seal paths to the deck for moisture that may have been formed by the installation of the steel plate;

an aluminum plate having holes and a post for a railing;

whereby lightweight concrete can be poured on the moisture barrier and the steel plate and the aluminum plate with a post for a railing can be mounted atop the lightweight concrete by aligning the holes in the aluminum plate with the studs with the studs having nuts above and below the aluminum plate to hold the aluminum plate spaced above the steel plate.

17. A railing anchor assembly to be mounted on a balcony as claimed in claim 16 wherein the holes of the steel plate are arranged in two lines of three holes each.

18. A railing anchor assembly to be mounted on a balcony as claimed in claim 17 wherein the steel plate has a centerline marked between the two lines of three holes.

19. A railing anchor assembly to be mounted on a balcony as claimed in claim 16 further comprising shields configured to be installed to surround each stud between the metal plates to prevent contact of the concrete with the threads of the studs.

20. A railing anchor assembly to be mounted on a balcony as claimed in claim 19 wherein the shields are polyvinyl chloride sleeves.

* * * * *